US008602619B2

(12) United States Patent
Matsunaga

(10) Patent No.: US 8,602,619 B2
(45) Date of Patent: Dec. 10, 2013

(54) LIGHT SOURCE MODULE AND VEHICLE LAMP

(75) Inventor: Takashi Matsunaga, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 444 days.

(21) Appl. No.: 12/692,268

(22) Filed: Jan. 22, 2010

(65) Prior Publication Data

US 2010/0208480 A1 Aug. 19, 2010

(30) Foreign Application Priority Data

Feb. 16, 2009 (JP) ..... 2009-032376

(51) Int. Cl.

| | |
|---|---|
| ***F21S 8/10*** | (2006.01) |
| ***F21V 21/00*** | (2006.01) |
| ***F21V 11/00*** | (2006.01) |
| ***F21V 29/00*** | (2006.01) |
| ***H01R 33/00*** | (2006.01) |

(52) U.S. Cl.

USPC ..... 362/545; 362/543; 362/646

(58) Field of Classification Search

USPC ..... 362/545, 646, 543

See application file for complete search history.

(56) References Cited

U.S. PATENT DOCUMENTS

| | | | | |
|---|---|---|---|---|
| 7,134,774 | B2 * | 11/2006 | Iwasaki | 362/517 |
| 7,258,466 | B2 * | 8/2007 | Watanabe et al. | 362/294 |
| 7,344,296 | B2 * | 3/2008 | Matsui et al. | 362/652 |
| 7,441,933 | B2 * | 10/2008 | Tsukamoto et al. | 362/548 |
| 7,535,727 | B2 * | 5/2009 | Tokida | 361/760 |
| 2006/0044840 | A1 * | 3/2006 | Watanabe et al. | 362/647 |
| 2006/0239021 | A1 * | 10/2006 | Inaba | 362/538 |
| 2007/0171662 | A1 * | 7/2007 | Tokida | 362/459 |
| 2007/0171667 | A1 * | 7/2007 | Watanabe et al. | 362/545 |
| 2007/0177401 | A1 * | 8/2007 | Nakabayashi | 362/548 |
| 2008/0144320 | A1 | 6/2008 | Tokunaga | |

FOREIGN PATENT DOCUMENTS

| | | | |
|---|---|---|---|
| CN | 101078483 | A | 11/2007 |
| JP | 2004-265626 | | 2/2004 |
| JP | 2006-066108 | A | 3/2006 |
| JP | 2007-242267 | | 9/2007 |
| JP | 2007-311482 | A | 11/2007 |
| JP | 2008-305718 | A | 12/2008 |

OTHER PUBLICATIONS

Chinese Office Action, dated Mar. 23, 2011, Application No. 201010115945.X.

Office Action in corresponding Japanese Patent Application No. 2009-032376 dated Feb. 12, 2013.

* cited by examiner

*Primary Examiner* — David J Makiya

(74) *Attorney, Agent, or Firm* — Sughrue Mion, PLLC

(57) ABSTRACT

A light source module includes: a light emitting diode; a circuit board configured to be mounted on a base plate, the circuit board having a top face on which a circuit pattern is formed; and a power feeding attachment including a resin member and a conductive member, wherein the circuit pattern includes: a pair of power feeding portions; and a light source connecting portion on which the light emitting diode is placed and electrically connecting the pair of power feeding portions and the light emitting diode, and wherein the conductive member includes: a pair of connecting terminals being exposed from the resin member and respectively connected to the pair of power feeding portions; and a pressing piece being exposed from the resin member and configured to press the circuit board against the base plate at an outer peripheral portion of the circuit board.

7 Claims, 7 Drawing Sheets

LIGHT SOURCE MODULE AND VEHICLE LAMP

CROSS REFERENCE TO RELATED APPLICATION(S)

The present disclosure relates to the subject matters contained in Japanese Patent Application No. 2009-032376 filed on Feb. 16, 2009, which are incorporated herein by reference in its entirety.

FIELD

The present invention relates to a light source module and a vehicle lamp having the light source module.

BACKGROUND

Some light source modules use a light emitting diode (LED) as a light source. The light source modules are provided in a vehicle lamp that irradiates a light emitted from the light source as an illuminating light.

Some of such light source modules are configured to have: a circuit board provided with a light emitting diode; and a power feeding attachment connected to a power circuit and feeding a power to the light emitting diode, wherein a pair of connecting terminals provided in the power feeding attachment are connected to a pair of power feeding portions formed on the circuit board, respectively. An example of such light source module is disclosed in JP-A-2006-066108 (counterpart U.S. publication is: US 2006/044840 A1).

When the connecting terminal portion of the power feeding attachment is connected to the power feeding portion of the circuit board, the circuit board is disposed on a base plate such as a radiating plate in a state in which an outer peripheral portion is pressed by a pressing portion.

The light source module as described above has been desired to have the circuit board to be smaller in size for reducing a size of a vehicle lamp.

In the light source module described in JP-A-2006-066108, the pressing portion for pressing the circuit board is formed by a resin material. Therefore, a thickness of the pressing portion is increased to ensure a high rigidity.

In the case in which a size of the circuit board is to be reduced, however, the light emitting diode provided on the circuit board is close to the pressing portion which presses the outer peripheral portion of the circuit board. Therefore, a light emitted toward a side from the light emitting diode, that is, in a planar direction of the circuit board is apt to be shielded by the pressing portion. Thus, there may be caused a disadvantage that a utilization efficiency of a light is reduced or a necessary light distribution pattern cannot be obtained.

SUMMARY

One of objects of the present invention is to provide a light source module and a vehicle lamp capable of reducing a size and while enhancing a utilization efficiency of a light.

According to a first aspect of the invention, there is provided a light source module including: a light emitting diode; a circuit board configured to be mounted on a base plate, the circuit board having a top face on which a circuit pattern is formed; and a power feeding attachment including a resin member and a conductive member, wherein the circuit pattern includes: a pair of power feeding portions; and a light source connecting portion on which the light emitting diode is placed and electrically connecting the pair of power feeding portions and the light emitting diode, and wherein the conductive member includes: a pair of connecting terminals being exposed from the resin member and respectively connected to the pair of power feeding portions; and a pressing piece being exposed from the resin member and configured to press the circuit board against the base plate at an outer peripheral portion of the circuit board.

According to a second aspect of the invention, there is provided a vehicle lamp including: a lamp room; a base plate that is disposed in the lamp room; a light source module that is configured to emit light; and an optical member that exerts optical function on the light emitted from the light source module, wherein the light source module includes: a light emitting diode that emits the light; a circuit board configured to be mounted on a base plate, the circuit board having a top face on which a circuit pattern is formed; and a power feeding attachment including: a resin member molded by a resin; and a conductive member formed by a metal and partially buried in the resin member, wherein the circuit pattern includes: a pair of power feeding portions; and a light source connecting portion on which the light emitting diode is placed and electrically connecting the pair of power feeding portions and the light emitting diode, and wherein the conductive member includes: a pair of connecting terminals being exposed from the resin member and respectively connected to the pair of power feeding portions; and a pressing piece being exposed from the resin member and configured to press the circuit board against the base plate at an outer peripheral portion of the circuit board.

BRIEF DESCRIPTION OF THE DRAWINGS

A general configuration that implements the various feature of the invention will be described with reference to the drawings. The drawings and the associated descriptions are provided to illustrate embodiments of the invention and not to limit the scope of the invention.

DETAILED DESCRIPTION OF THE EMBODIMENT(S)

An example of a light source module and a vehicle lamp according to an embodiment of the present invention will be hereinafter described with reference to the accompanying drawings.

In the embodiment which will be described below, the vehicle lamp according to the invention is applied to a vehicle headlamp and the light source module according to the invention is applied to a light source module provided in the vehicle headlamp. A coverage of the vehicle lamp and the light source module according to the invention is not limited to the vehicle headlamp and the light source module provided in the vehicle headlamp but the invention can be applied to various lighting devices for a vehicle which are attached to a body other than the vehicle headlamp, and light source modules provided in the various lighting devices for a vehicle.

A vehicle lamp 1 (a vehicle headlamp) is disposed to be attached to both of left and right ends in a front end of a body, respectively.

Figure 1:
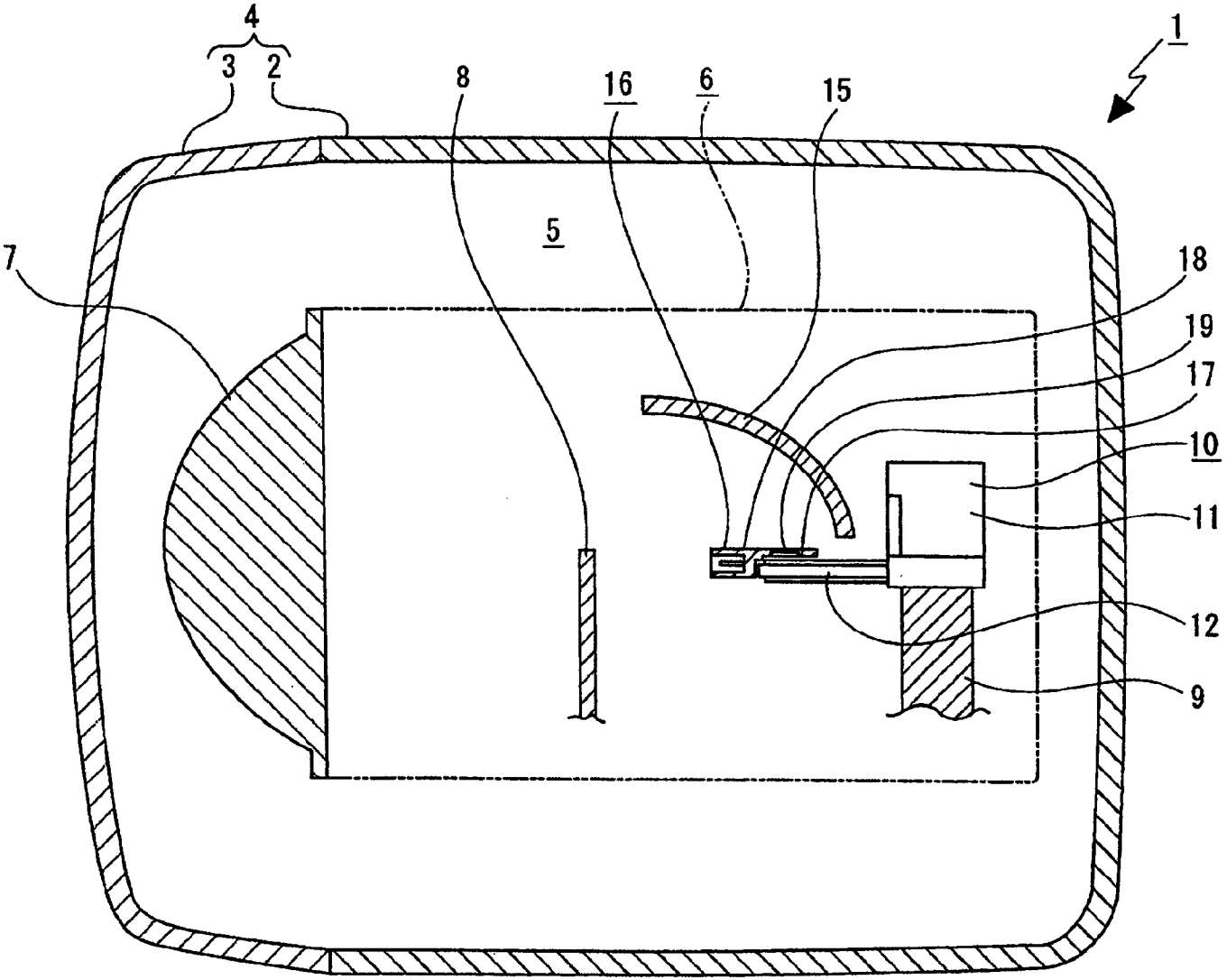
FIG. 1 is a schematic sectional view showing a vehicle lamp.

As shown in FIG. 1, the vehicle lamp 1 includes a lamp body 2 having a concave portion opened forward and a cover 3 for closing an opening surface of the lamp body 2, and an outer housing 4 is formed by the lamp body 2 and the cover 3. An inner part of the outer housing 4 is formed as a lamp room 5.

A lighting unit 6 is disposed in the lamp room 5. The lighting unit 6 is supported on the lamp body 2 to be tiltable by an optical axis adjusting mechanism, which is not shown.

The lighting unit 6 is provided with a lens 7, a shade 8, an attaching member 9 and a light source retaining member 10.

The lens 7 is formed to have a substantially hemispherical shape, for example. The lens 7 serves as an optical member for projecting a light emitted from a light emitting diode (a light source), which will be described below, toward a forward direction of the vehicle.

The shade 8 is disposed behind the lens 7 and can be moved in a vertical direction, for example. The shade 8 serves as an optical member for shielding a part of the light emitted from the light emitting diode (the light source).

The attaching member 9 is disposed behind the shade 8. The light source retaining member 10 is attached to the attaching member 9.

The light source retaining member 10 serves as a heat radiating member for discharging a heat generated in a light source module which will be described below. The light source retaining member 10 has a radiating portion 11 and a base plate 12 protruded forward from the radiating portion 11 and having substantially flat plate shape (see FIG. 2).

The radiating portion 11 is provided with a plurality of radiating fins 11*a* and 11*a* apart from each other in a transverse direction.

In the base plate 12, parts excluding both of left and right side portions and a front end are provided as a substrate disposing portion 13 which is raised by one step, and both of the left and right side portions and the front end are provided as an attaching surface portion 14.

A part on the front end side of the substrate disposing portion 13 is provided with positioning protruded pins 13*a* and 13*a* which are protruded upward.

Screw holes 14*a* and 14*a* are formed on front ends at both of left and right ends of the attaching surface portion 14, respectively. Positioning projections 14*b* and 14*b* which are protruded upward are provided before and behind the screw holes 14*a* and 14*a*, respectively.

A reflector 15 is disposed above the base plate 12 (see FIG. 1). The reflector 15 serves as an optical member that exerts an optical function for reflecting a light emitted from the light emitting diode (the light source) and guiding the reflected light to the lens 7.

Figure 2:
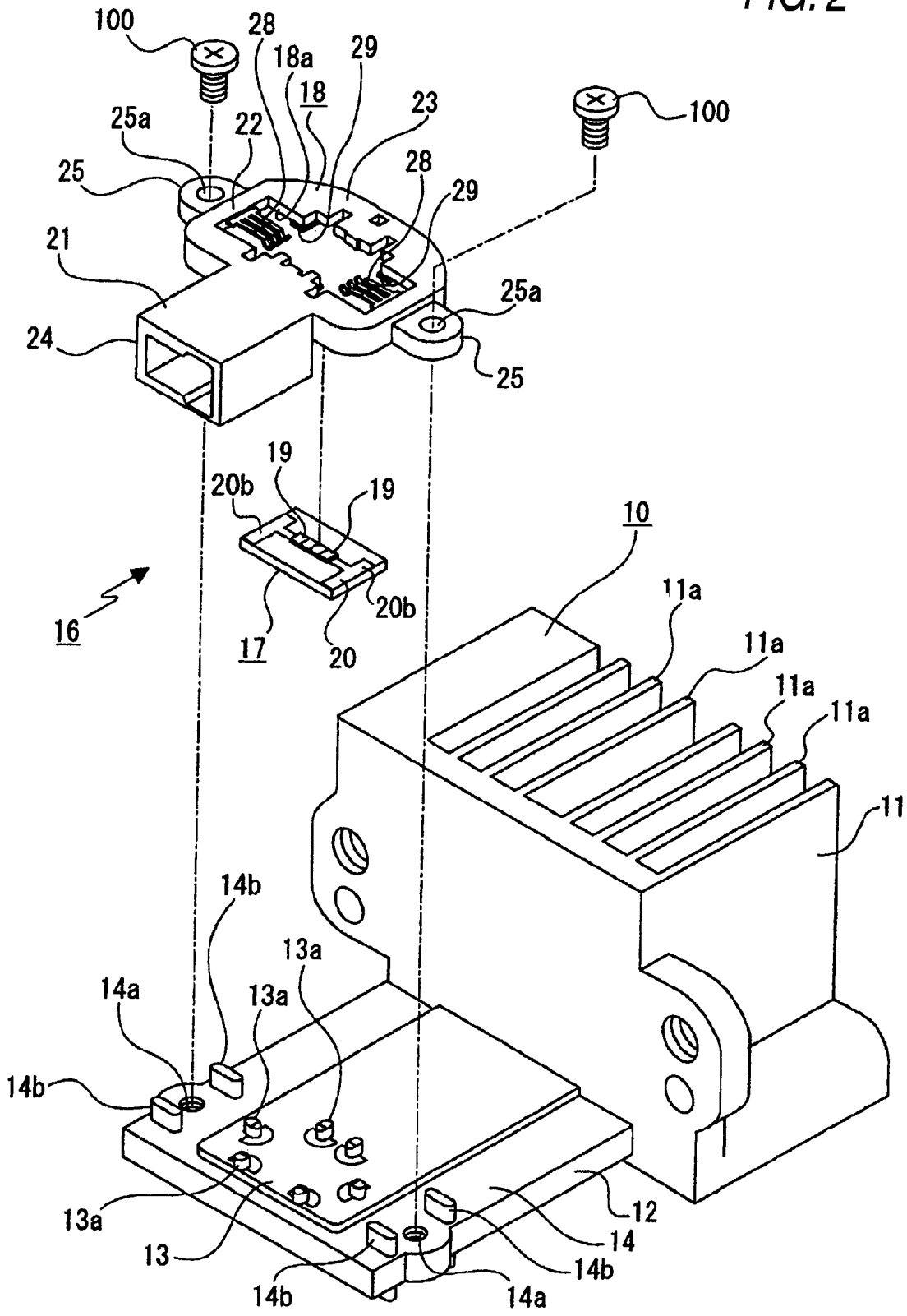
FIG. 2 is an exploded perspective view showing a light source module and a light source retaining member.
Figure 3:
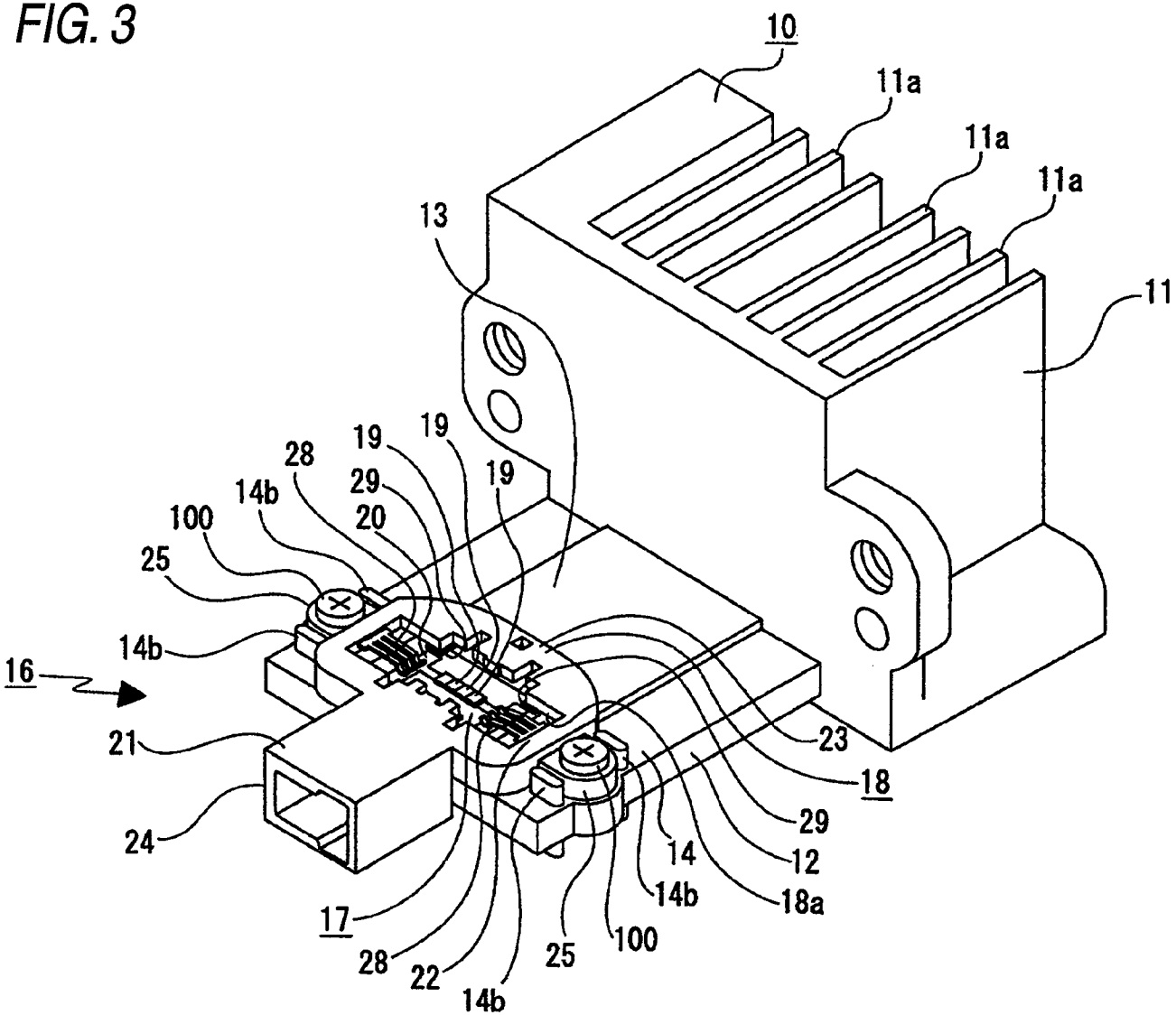
FIG. 3 is a perspective view showing the light source module and the light source retaining member.

Alight source module 16 is disposed on the base plate 12 (see FIGS. 2 and 3). The light source module 16 has a circuit board 17 to be mounted on the base plate 12 and a power feeding attachment 18 to be attached to the base plate 12 in a state in which the circuit board 17 is pressed.

The circuit board 17 is formed to have a shape of an oblong rectangle, for example, and has a plurality of light emitting diodes (LEDs) 19 and 19 provided in a central part.

The circuit board 17 is provided with an insulating portion having no conductivity and a conductive member having the conductivity in a lamination. The insulating portion is formed by an epoxy based resin material, for example, and the conductive member is formed of aluminum, for example.

A circuit pattern 20 is formed on an upper face of the circuit board 17. The circuit pattern 20 serves to connect the light emitting diodes 19 and 19 and is formed through an execution of copper plating, for example.

Figure 4:
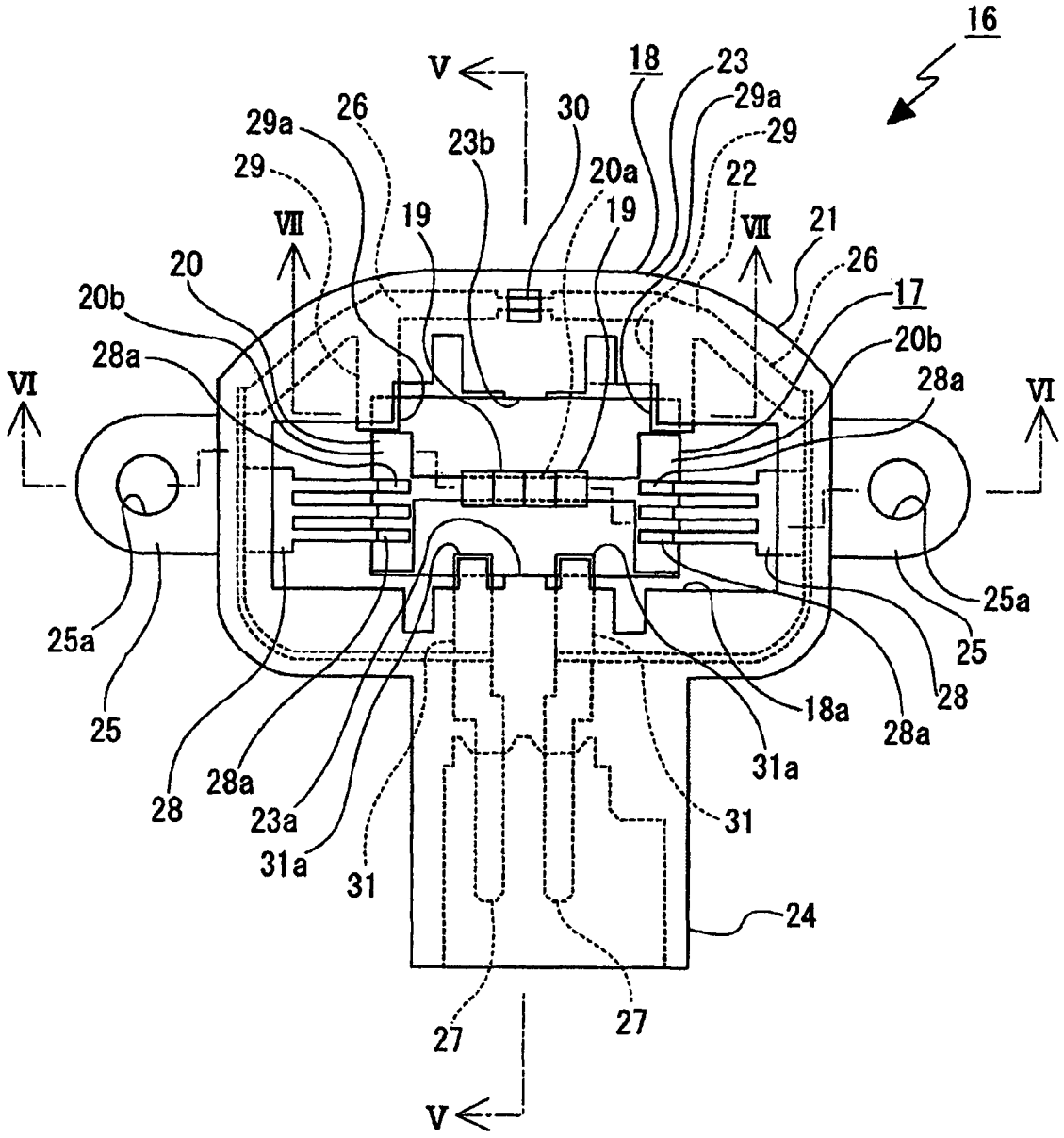
FIG. 4 is an enlarged plan view showing the light source module.

As shown in FIG. 4, the circuit pattern 20 has a light source connecting portion 20*a* positioned below the light emitting diodes 19 and 19 and a pair of power feeding portions 20*b* and 20*b* positioned continuously on left and right of the light source connecting portion 20*a* respectively. The power feeding portions 20*b* and 20*b* are positioned in parts excluding rear ends at both of the left and right ends of the circuit board 17.

The power feeding attachment 18 has a resin member 21 formed by a resin material and a conductive member 22 formed by a metallic material (see FIGS. 2 to 4). The power feeding attachment 18 is formed by so-called insert molding, that is, disposing a metal member in a predetermined position in a cavity of a metal mold and curing a molten resin filled in the cavity, thereby molding the metal member and the resin monolithically, for example.

The resin member 21 has a frame-shaped portion 23, a connector case portion 24 protruded forward from the frame-shaped portion 23, and attached piece portions 25 and 25 which are protruded transversely from the frame-shaped portion 23 respectively.

Figure 5:
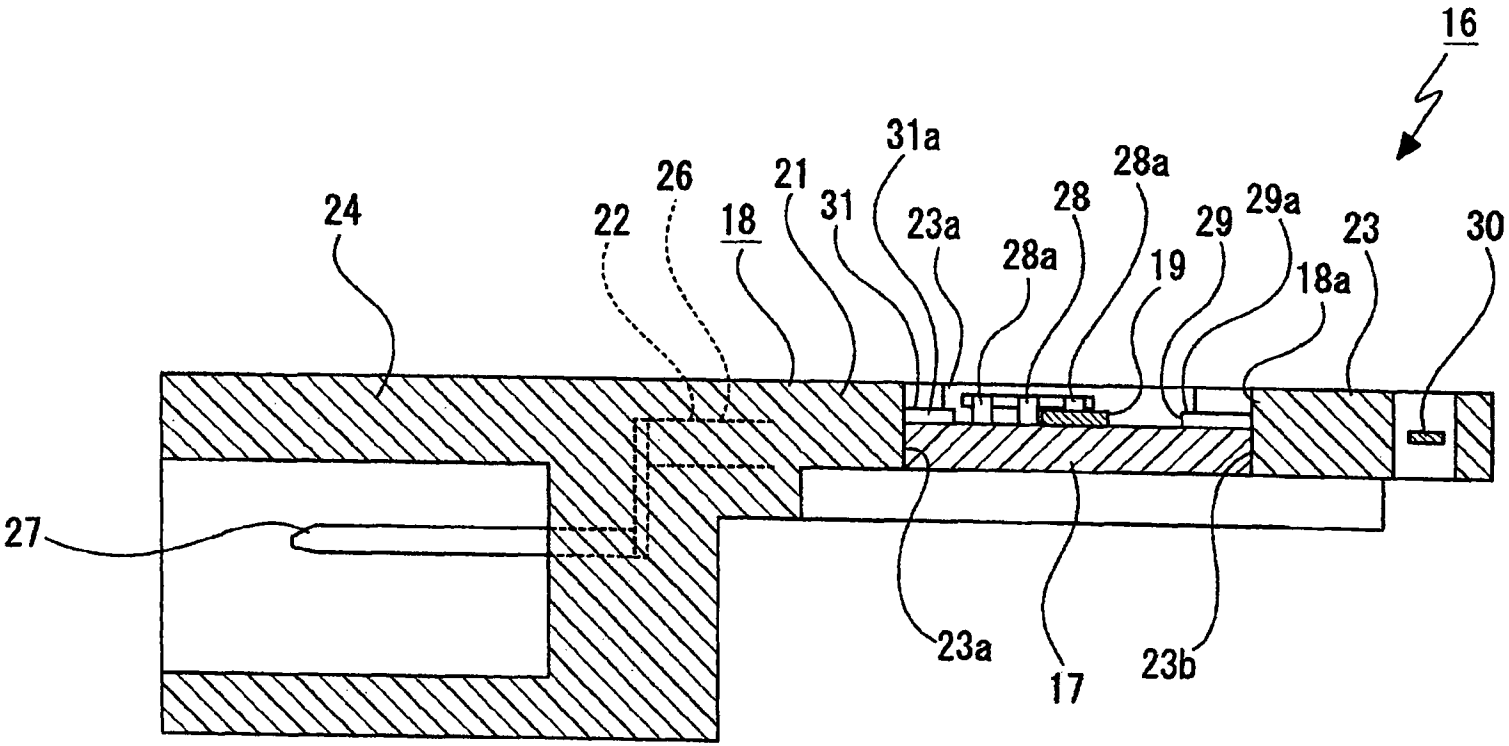
FIG. 5 is an enlarged sectional view taken along a V-V line shown in FIG. 4.

An inner opening of the frame-shaped portion 23 in the power feeding attachment 18 is formed as a disposing opening 18*a*. A front opening edge of the disposing opening 18*a* is provided with a positioning protruded portion 23*a* which is protruded rearward in a central part in a transverse direction (see FIGS. 4 and 5). A rear opening edge of the disposing opening 18*a* is provided with a positioning protruded portion 23*b* which is protruded forward in a central part in the transverse direction.

The positioning protruded portions 23*a* and 23*b* serve to position the circuit board 17 in a longitudinal direction.

The connector case portion 24 is formed to have substantially prismatic shape which is opened forward. In the connector case portion 24, parts other than an upper end are positioned below the frame-shaped portion 23.

Figure 6:
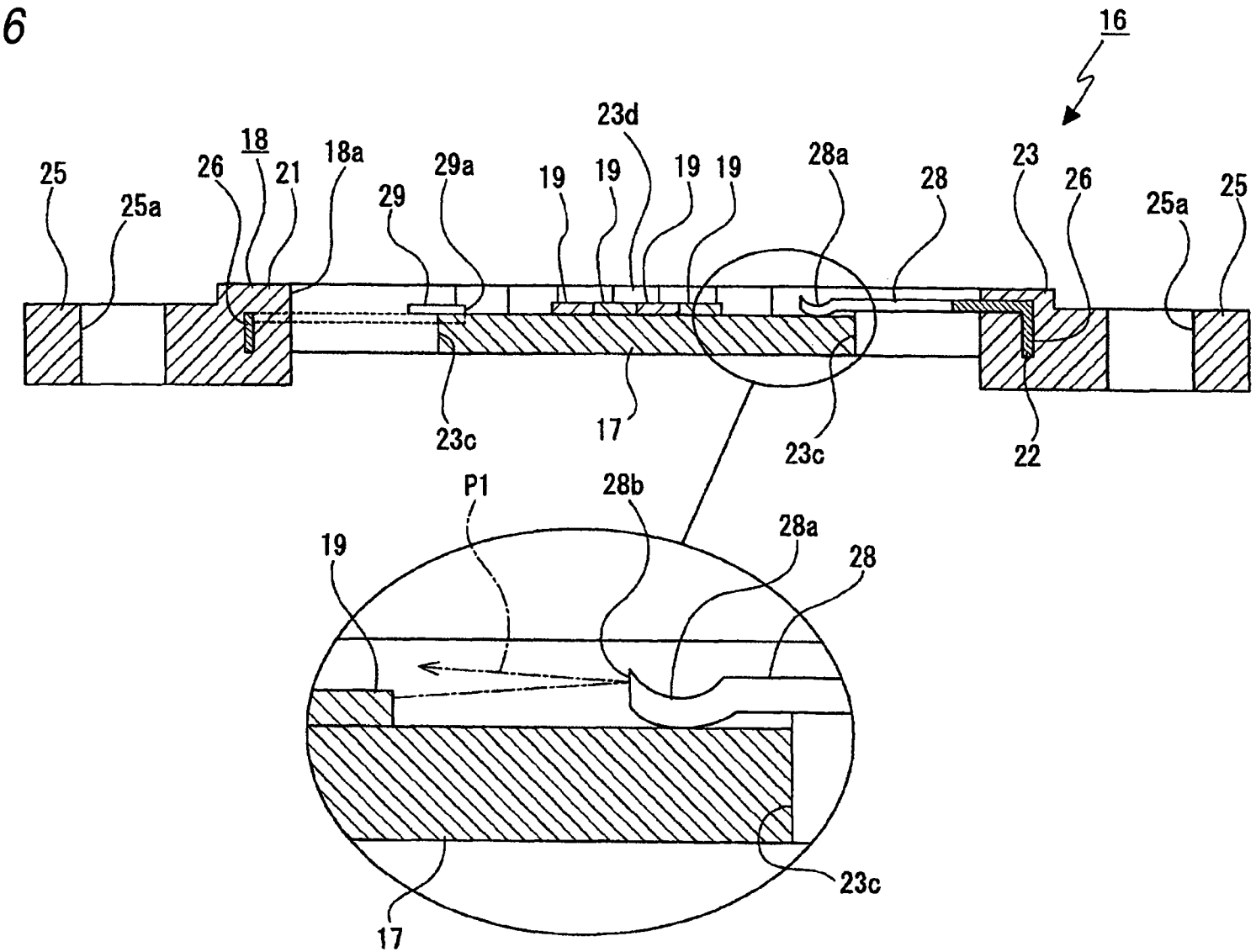
FIG. 6 is an enlarged sectional view taken along a VI-VI line shown in FIG. 4.

Upper faces of the attached piece portions 25 and 25 are formed in lower positions than an upper face of the frame-shaped portion 23 (see FIG. 6). Screw inserting holes 25*a* and 25*a* penetrating vertically are formed on the attached piece portions 25 and 25, respectively.

The conductive member 22 of the power feeding attachment 18 is buried in the resin member 21 except for a part (see FIG. 4). The conductive member 22 has base portions 26 and 26 formed to have substantially U shape which is opened leftward or rightward, connecter terminal portions 27 and 27 which are protruded forward from inner ends at front ends of the base portions 26 and 26 respectively, connecting terminals 28 and 28 which are protruded in an approaching direction to each other from both of left and right ends of the base portions 26 and 26, rear protruded portions 29 and 29 which are protruded forward from close positions to the inner ends at rear ends of the base portions 26 and 26 respectively, a coupling portion 30 for coupling the rear ends of the base portions 26 and 26, and front protruded portions 31 and 31 which are protruded rearward from the inner ends at the front ends of the base portions 26 and 26 respectively.

The base portions 26 and 26 are totally buried in the resin member 21.

The connector terminal portions 27 and 27 have their substantially second half parts being buried in the resin member 21 respectively, and their substantially first half parts being protruded forward from the resin member 21 and positioned in the connector case portion 24.

The connecting terminals 28 and 28 are provided as elastic connecting portions 28*a* and 28*a* having a spring property in which portions excluding outer ends are formed to be three-forked, respectively. A tip surface 28*b* of the elastic connecting portion 28*a* is formed to be turned in a transverse direction (see FIG. 6).

The tip surface 28*b* of the elastic connecting portion 28*a* is formed to be turned in the transverse direction. Therefore, a light (P1 in FIG. 6) emitted from the light emitting diodes 19 and 19 and reflected by the tip surface 28*b* of the elastic connecting portion 28*a* is turned in upward and longitudinal directions with difficulty. Thus, it is possible to prevent an unnecessary light for a light distribution or a stray light from being generated.

The rear protruded portions 29 and 29 are formed like plates turned in a vertical direction respectively and have front ends provided as pressing pieces 29*a* and 29*a* which are protruded from the resin member 21 (see FIGS. 4 and 6).

Figure 7:
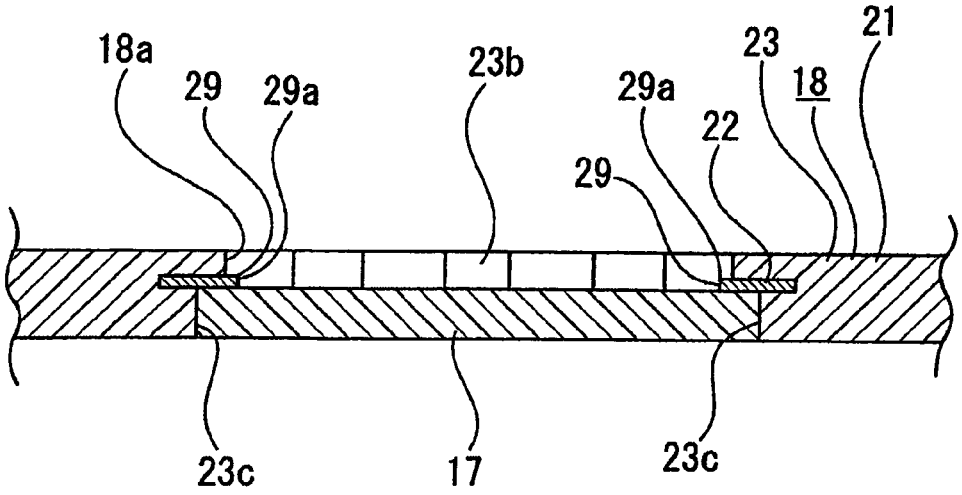
FIG. 7 is an enlarged sectional view taken along a VII-VII line shown in FIG. 4.

A part of the resin member 21 is present at a lower side in the front ends of the rear protruded portions 29 and 29 respectively as shown in FIG. 7 and is provided as positioning portions 23*c* and 23*c* respectively. The positioning portions 23*c* and 23*c* have opposed surfaces positioned on an outside of opposed surfaces at the front ends of the rear protruded portions 29 and 29.

The positioning portions 23*c* and 23*c* serve to position the circuit board 17 in the transverse direction.

A protecting terminal for a reverse connecting prevention (not shown) is attached to the coupling portion 30.

The front protruded portions 31 and 31 are formed like plates turned in the vertical direction respectively and have rear ends provided as pressing pieces 31*a* and 31*a* which are protruded from the resin member 21 (see FIGS. 4 and 6).

In the light source module 16 constituted as described above, the circuit board 17 is mounted on the substrate disposing portion 13 in the base plate 12 of the light source retaining member 10. At this time, the circuit board 17 is positioned with respect to the substrate disposing portion 13 by means of the positioning protruded pins 13*a* and 13*a*.

Subsequently, the power feeding attachment 18 is disposed on the base plate 12 to cover the circuit board 17 from above. When the power feeding attachment 18 is to be disposed on the base plate 12, the attached piece portions 25 and 25 are positioned with respect to the base plate 12 by means of the positioning projections 14*b* and 14*b* provided on the base plate 12 and the screw inserting holes 25*a* and 25*a* of the attached piece portions 25 and 25 are positioned just above the screw holes 14*a* and 14*a* of the base plate 12 respectively.

In a state in which the power feeding attachment 18 is disposed on the base plate 12, as shown in FIGS. 4 to 7, the elastic connecting portions 28*a* and 28*a* of the conductive member 22 are pressed against the power feeding portions 20*b* and 20*b* of the circuit board 17 from above and are thus connected respectively, and an outer peripheral portion of the circuit board 17 is pressed from above and is thus pushed against the base plate 12 through the pressing pieces 29*a*, 29*a*, 31*a* and 31*a* of the conductive member 22. Close parts to a center in the transverse direction of the front end of the circuit board 17 are pressed by the pressing pieces 31*a* and 31*a* respectively so that two corner portions positioned on a rear side of the power feeding portions 20*b* and 20*b* are pressed by the pressing pieces 29*a* and 29*a*, respectively.

At this state, the circuit board 17 is positioned in a longitudinal direction with respect to the power feeding attachment 18 through the positioning protruded portions 23*a* and 23*b* of the power feeding attachment 18 and is positioned in a transverse direction with respect to the power feeding attachment 18 through the positioning portions 23*c* and 23*c* of the power feeding attachment 18.

Thereafter, attaching screws 100 and 100 are inserted through the screw inserting holes 25*a* and 25*a* of the attached piece portions 25 and 25 and are thus fixed into the screw holes 14*a* and 14*a* of the base plate 12, respectively. Consequently, the power feeding attachment 18 is attached to the base plate 12 (see FIG. 3).

In the vehicle lamp 1, when a light is emitted from the light emitting diodes 19 and 19, the emitted light is reflected by the reflector 15, is transmitted through the lens 7 and the cover 3 and is irradiated forward. At this time, the light emitted from the light emitting diodes 19 and 19 is also turned toward the side, that is, in the planar direction of the circuit board 17 including the longitudinal and transverse directions. Since the pressing pieces 29*a*, 29*a*, 31*a* and 31*a* for pressing the circuit board 17 are formed by a metallic material, however, it is possible to ensure a high rigidity and to reduce a thickness.

Accordingly, it is possible to reliably push the circuit board 17 against the base plate 12 by pressing through the pressing pieces 29*a*, 29*a*, 31*a* and 31*a* and to reduce a quantity of the light which is turned from the light emitting diodes 19 and 19 toward the side and is to be shielded by the power feeding attachment 18.

As described above, in the light source module 16, the circuit board 17 is pressed by means of the pressing pieces 29*a*, 29*a*, 31*a* and 31*a* formed by the metallic material. Therefore, it is possible to ensure a high rigidity of the pressing pieces 29*a*, 29*a*, 31*a* and 31*a* and to reduce a thickness.

Also in the case in which a distance between the light emitting diodes 19 and 19 and the outer periphery of the circuit board 17 is decreased in order to reduce the size of the circuit board 17, accordingly, it is possible to decrease a quantity of a light to be shielded, to ensure a reduction in the size of the light source module 16, and furthermore, to enhance a utilization efficiency of a light and to ensure a desirable light distribution pattern.

In the light source module 16, moreover, the resin member 21 of the power feeding attachment 18 is provided with the positioning portions 23*c* and 23*c* for positioning the circuit board 17. Therefore, it is not necessary to provide a dedicated positioning portion separately. Thus, it is possible to decrease the number of the components.

In the light source module 16, furthermore, the connecting terminals 28 and 28 and the pressing pieces 29*a*, 29*a*, 31*a* and 31*a* are formed monolithically. Therefore, it is possible to reduce a manufacturing cost through the decrease in the number of the components.

In addition, the upper faces of the attached piece portions 25 and 25 in the power feeding attachment 18 are formed in the lower positions than the upper face of the frame-shaped portion 23. Therefore, the attached piece portions 25 and 25 can prevent the light emitted from the light emitting diodes 19 and 19 toward the side from being shielded. Thus, it is possible to enhance the utilization efficiency of the light still more.

The shape and structure of each of the portions described in the best mode is only illustrative for an implementation for carrying out the invention and the technical field of the invention should not be construed to be restrictive.

It is to be understood that the present invention is not limited to the specific embodiment described above and that the invention can be embodied with the components modified without departing from the spirit and scope of the invention.

The invention can be embodied in various forms according to appropriate combinations of the components disclosed in the embodiment described above. For example, some components may be deleted from the configuration shown as the embodiment.

What is claimed is:

1. A light source module comprising:

a light emitting diode;

a circuit board configured to be mounted on a base plate, the circuit board having a top face on which a circuit pattern is formed; and a power feeding attachment comprising: a resin member molded by a resin; and a conductive member formed by a metal and partially buried in the resin member, wherein the circuit pattern comprises: a pair of power feeding portions; and a light source connecting portion on which the light emitting diode is placed and electrically connecting the pair of power feeding portions and the light emitting diode, and wherein the conductive member comprises:

a pair of connecting terminals being exposed from the resin member and respectively connected to the pair of power feeding portions; and a pressing piece being exposed from the resin member and configured to press the circuit board against the base plate at an outer peripheral portion of the circuit board;

wherein the pressing piece is discrete from the connecting terminals, and the pressing piece presses the circuit board without pressing the power feeding portions.

2. The light source module according to claim 1, wherein the resin member comprises a positioning portion that positions the circuit board with respect to the power feeding attachment.

3. The light source module according to claim 1, wherein one of the pair of connecting terminals and the pressing piece are monolithically formed.

4. The light source module according to claim 1, wherein the pressing piece comprises at least a pair of pressing piece portions being arranged at symmetrical positions with respect to the circuit board, and wherein the pair of connecting terminals and the pair of pressing piece portions are monolithically formed respectively.

5. A vehicle lamp comprising:

a lamp room;

a base plate that is disposed in the lamp room;

a light source module that is configured to emit light; and an optical member that exerts optical function on the light emitted from the light source module, wherein the light source module comprises:

a light emitting diode that emits the light;

a circuit board configured to be mounted on a base plate, the circuit board having a top face on which a circuit pattern is formed; and a power feeding attachment comprising: a resin member molded by a resin; and a conductive member formed by a metal and partially buried in the resin member, wherein the circuit pattern comprises: a pair of power feeding portions; and a light source connecting portion on which the light emitting diode is placed and electrically connecting the pair of power feeding portions and the light emitting diode, and wherein the conductive member comprises:

a pair of connecting terminals being exposed from the resin member and respectively connected to the pair of power feeding portions; and a pressing piece being exposed from the resin member and configured to press the circuit board against the base plate at an outer peripheral portion of the circuit board;

wherein the pressing piece is discrete from the connecting terminals, and the pressing piece presses the circuit board without pressing the power feeding portions.

6. The light source module according to claim 1, wherein the pair of connecting terminals comprise elastic connecting portions having a spring property, and the pressing piece comprise a plate having an end protruded from the resin member.

7. The vehicle lamp according to claim 5, wherein the pair of connecting terminals comprise elastic connecting portions having a spring property, and the pressing piece comprises a plate having an end protruded from the resin member.

* * * * *